United States Patent [19]

Kodama

[11] Patent Number: 4,907,563

[45] Date of Patent: Mar. 13, 1990

[54] HOUSING OF A DISTRIBUTOR INCLUDING AN IGNITION COIL FOR AN INTERNAL COMBUSTION ENGINE

[75] Inventor: Seiki Kodama, Himeji, Japan

[73] Assignee: Mitsubishi Denki Kabushiki Kaisha, Tokyo, Japan

[21] Appl. No.: 259,376

[22] Filed: Oct. 18, 1988

[30] Foreign Application Priority Data

Nov. 9, 1987 [JP] Japan ..... 62-170984

[51] Int. Cl.[4] ..... F01P 1/00

[52] U.S. Cl. ..... 123/635; 123/146.5 A

[58] Field of Search ..... 123/146.5 A, 634, 635

[56] References Cited

U.S. PATENT DOCUMENTS

| | | | |
|---|---|---|---|
| 1,277,388 | 9/1918 | Conrad | 123/635 X |
| 1,332,758 | 3/1920 | Rosner | 123/635 X |
| 1,917,046 | 7/1933 | Martin | 123/635 |
| 2,662,105 | 12/1953 | Bales | 123/635 X |
| 4,365,609 | 12/1982 | Toyama et al. | 123/635 |

FOREIGN PATENT DOCUMENTS

| | | | |
|---|---|---|---|
| 2432096 | 3/1980 | France | 123/635 |
| 0018834 | 5/1983 | Japan . | |

*Primary Examiner*—Willis R. Wolfe
*Attorney, Agent, or Firm*—Sughrue, Mion, Zinn, Macpeak and Seas

[57] ABSTRACT

A housing structure of a distributor for an internal combustion engine including an ignition coil is disclosed. The housing structure comprises a cup-shaped base accommodating the ignition coil and a cap fitted thereon and accommodating a distributor rotor. A cap-shaped partitioning cover is disposed between the base and the cap to separate the distributor rotor portion therefrom. The high output voltage of the ignition coil is supplied to the distributor rotor through a hollow cylindrical tower fixed to the ignition coil and an insertion electrode which is integral with the cap and fits into the hollow cylindrical tower. The cover has a cap-shaped side extension having a annular disk-shaped top which passes through the insertion electrode. A sealing member, which is disposed between the side extension of the cover and the top portion of the high-voltage tower, includes a portion tightly held between the top end of the tower and the top annular disk of the cap-shaped side extension, and a surface tightly pressed against the side surface of the insertion electrode.

4 Claims, 2 Drawing Sheets

HOUSING OF A DISTRIBUTOR INCLUDING AN IGNITION COIL FOR AN INTERNAL COMBUSTION ENGINE

BACKGROUND OF THE INVENTION

1. Field of the Invention

The present invention relates to a housing structure of a distributor for an internal combustion engine including an ignition coil.

2. Description of the Related Art

FIG. 1 shows a longitudinal section of a distributor for an internal combustion engine which includes an ignition coil for generating high voltage supplied to the spark plugs of the engine.

The distributor may be divided into rotating and stationary portions. The rotating portion of the distributor comprises: a shaft 1 rotating in synchronism with the crankshaft of an internal combustion engine; a spark advancing sleeve 2 rotatably mounted on the shaft 1; a centrifugally-operated spark advancing mechanism 3 operatively coupling the spark advancing sleeve 2 to the shaft 1; a distributor rotor 4 fixed to the spark advancing sleeve 2 and including a brush **4*a* and a rotor electrode 4*b*; and a reluctor 5 in the form of a reluctance varying rotor formed of a magnetic material, the reluctor 5** having a plurality of projections extending radially outwardly from the outer circumferential surface thereof so that the reluctance therethrough is varied in synchronism with the rotation thereof.

The stationary portion of the distributor comprises: a cup-shaped housing base 6; an ignition coil 7 having a high-voltage tower 8 for outputting the high voltage from the secondary winding of the ignition coil 7; a housing cap 9 having an insertion electrode **9*a* fitted into a bore which is formed in the high-voltage tower 8, a central electrode 9*b* for supplying high voltage to the brush 4*a* of the distributor rotor 4, and a plurality of circumferentially spaced fixed electrodes 9*c* to which high voltage is supplied from the rotor electrode 4*b*; a vacuum-operated spark advancing mechanism 13 having a spark advancing annular plate 14 rotatably supported by the housing base 6; an ignition timing sensor 15 fixedly mounted on the spark advancing plate 14 in a spaced opposed relation with the reluctance varying rotor 5; and a waterproofing and leakage preventing cover 10 separating the high voltage distributing portion from the spark advancing mechanisms, etc., the cover 10 being held between the housing base 6 and the cap 9 through the intermediary of an annular sealing members 11 and 12**.

In operation, the angle advancing sleeve 2, which carries the reluctance varying rotor 5 and the distributor rotor 4, is driven by the shaft 1 through the intermediary of the centrifugally-operated spark advancing mechanism 3 so that the rotational angle of the sleeve 2 is advanced in proportion to the rotational speed of the shaft 1 through the intermediary of the centrifugally-operated spark advancing mechanism 3. On the other hand, the relative rotational position of the sensor 15 with respect to the housing is advanced by the vacuum-operated spark advancing mechanism 13, which adjusts the rotational position of the annular plate 14. Thus, the sensor 15, which detects the variation of the magnetic flux caused by the variation of the reluctance through the rotating rotor 5, generates an ignition timing signal at the optimum rotational position of the crankshaft of the internal combustion engine. The breaking and making of the current through the primary winding of the ignition coil is controlled by the ignition timing signal outputted from the sensor 15. The high voltage developed in the secondary winding of the ignition coil 7 is taken out from the high voltage tower 8 and supplied therefrom to the distributor rotor 4 through the insertion terminal **9*a*, the central electrode 9*b*, and the brush 4*a***.

In the housing structure shown in FIG. 1, the cover 10 is interposed between the housing base 6 and the housing cap 9 for two purposes; first, for preventing the high voltage applied to the rotor electrode **4*b* and the fixed electrodes 9*c* from leaking into the space thereunder accommodating the spark advancing mechanisms, etc.; second for preventing water from reaching the high-voltage distributing portion thereabove, when water enters from ventilating holes (not shown) formed around the spark advancing mechanisms, etc. Further, the high-voltage tower 8 comprises a deep recess into which the insertion electrode 9*a* is fitted, so that the high voltage does not leak therefrom, as shown in greater detail in FIG. 2. In addition, annular sealing members 11 and 12 are interposed between the circumferential annular flange 10*a* of the cover 10 and the annular end surfaces of the housing cap 9 and the housing base 6**, respectively, to waterproof the whole distributor.

In the conventional housing structure shown in FIGS. 1 and 2, the waterproofing of the engaging portion of the high voltage tower 8 is not enough, although the waterproofing thereof has crucial importance due to the high voltage supplied thereto. Namely, the water entering from the ventilating holes (not shown), which are formed in the housing base 6 for the purpose of exhausting NOX, etc., may reach the engaging portion of the high voltage tower 8.

SUMMARY OF THE INVENTION

Thus, a main object of the present invention is to provide a housing structure of a distributor for an internal combustion engine including an ignition coil in which the engaging portion of a high voltage tower supplying high voltage from the ignition coil is sealed in a watertight manner.

Another object of the present invention is to provide such a distributor housing structure which is simple in structure and can be produced at low cost.

The housing structure according to the present invention comprises: a cup-shaped housing base accommodating an ignition coil; first high-voltage lead means including a hollow cylindrical high-voltage tower for supplying high output voltage from the ignition coil; a housing cap fitted onto the housing base and accommodating a high-voltage distributing portion including a distributor rotor; second high-voltage lead means fixed to the housing cap and including a solid cylindrical insertion electrode which is fitted into a central bore in the hollow cylindrical high-voltage tower for leading the high voltage supplied from the high-voltage tower to the high voltage distributing portion of the distributor; a partitioning member in the form of a cover interposed between the housing base and the housing cap to separate the high-voltage distributing portion of the distributor, the partitioning member including a side extension which has a hole for allowing the insertion electrode to extend therethrough; and a sealing member disposed between the side extension of the partitioning member and the top portion of the high-voltage tower. The sealing member includes: a portion tightly held between the top portion of the high-voltage tower and the side extension of the partitioning member; and a sealing surface tightly pressed against the outer side surface of the insertion electrode. Thus, the engaging portion of the high-voltage tower receiving the insertion electrode is sealed in a watertight manner, thereby preventing water from penetrating thereinto, which water may, otherwise, enter the housing from ventilating holes in the distributor housing.

BRIEF DESCRIPTION OF THE DRAWINGS

Further details of the present invention, together with further objects and merits thereof, will become more clear in the following detailed description of a few preferred embodiments thereof when taken in conjunction with the accompanying drawings, in which.

In the drawings, like reference numerals represent like or corresponding parts or portions.

DETAILED DESCRIPTION OF THE PREFERRED EMBODIMENTS

Figure 3:
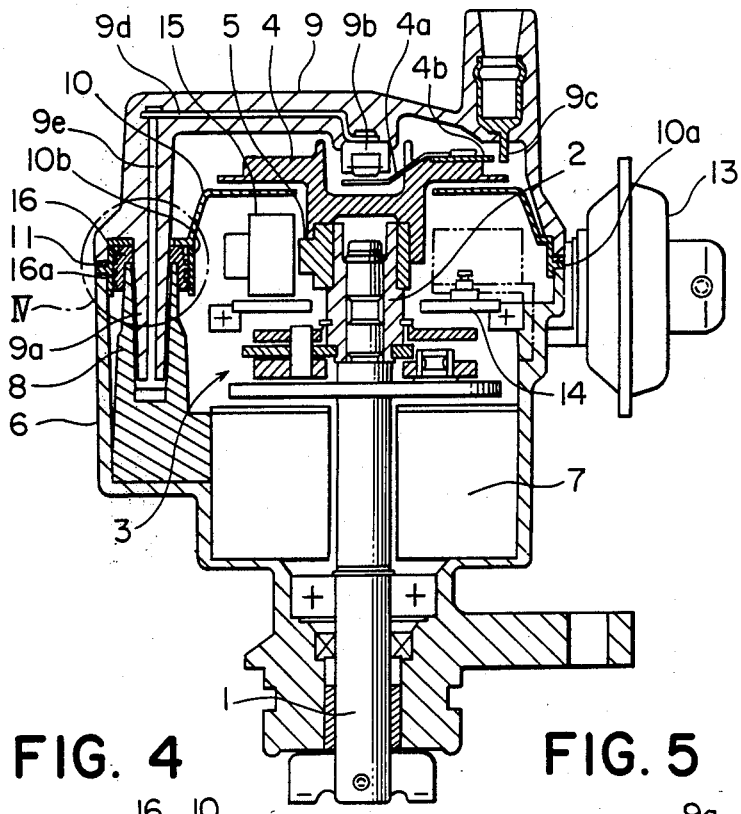
FIG. 3 is a view similar to FIG. 1, showing a first housing structure of a distributor according to the present invention.
Figure 4:
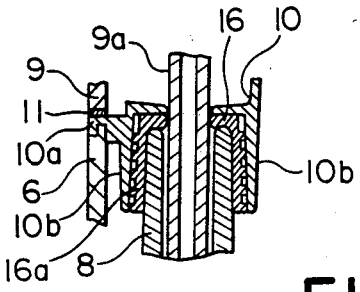
FIG. 4 is an enlarged sectional view showing the portion within the circle IV of FIG. 3.

Referring now to FIGS. 3 and 4 of the drawings, a first embodiment according to the present invention is described.

Figure 1:
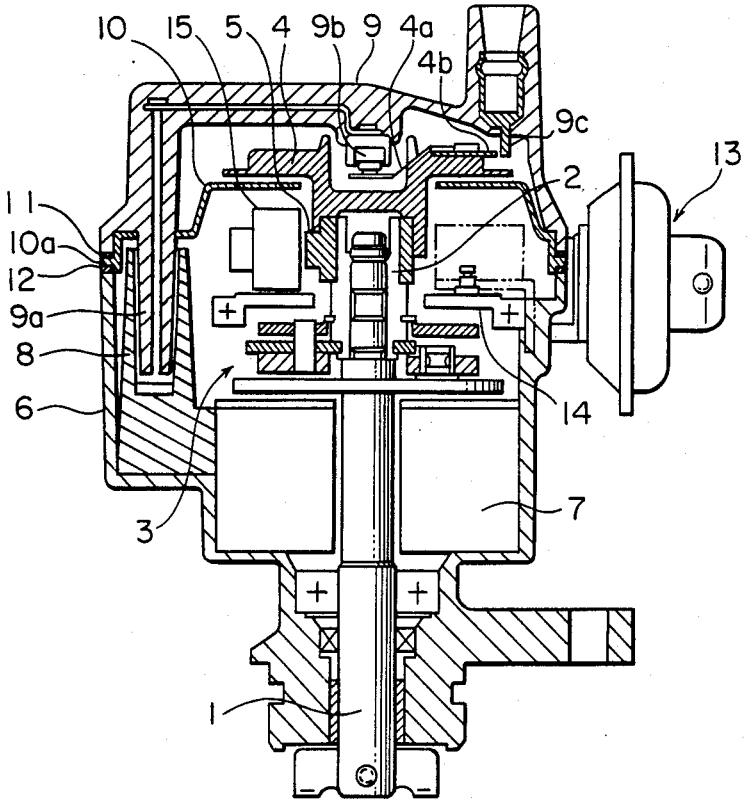
FIG. 1 is a longitudinal sectional view of a conventional distributor for an internal combustion engine.

The distributor shown in FIG. 3 is identical in structure and operation to that of FIG. 1 except for the sealing structure thereof. Thus, the rotating portion of the distributor of FIG. 3 is the same as the rotating portion of the distributor of FIG. 1.

The stationary portion of the distributor of FIG. 3 comprises a vacuum-operated spark advancing mechanism 13, a spark advancing annular plate 14, and a sensor 15, all of which are identical to corresponding parts of the distributor of FIG. 1. A cup-shaped housing base 6, which is made of aluminium and through which the shaft 1 of the distributor rotatably extends, accommodates an ignition coil 7, to a side surface of which a high-voltage tower 8 made of a resin is fixedly secured to lead the high output voltage from the secondary winding of the ignition coil 7. The high-voltage tower 8 has the form of a hollow cylinder extending in the axial direction of the distributor and has a cylindrical central bore which extends downward from the top end surface thereof, tapering in diameter from wide to narrow in the direction away from the top end of the high-voltage tower 8. The terminal of the output lead from the secondary winding of the ignition coil 7 is disposed at the bottom of the central bore of the high voltage tower 8. A housing cap 9, which has the same structure as that of FIG. 1, comprises a cylindrical insertion electrode **9*a* integral therewith which extends in the axial direction of the distributor, tapering in diameter from wide to narrow in the direction toward the top end surface thereof, so that the electrode 9*a* fits into the central bore in the high-voltage tower 8. The insertion electrode 9*a* comprises a centrally extending lead 9*e*, which leads the high output voltage supplied from the ignition coil 7 to a central electrode 9*b* through a lead 9*d***.

Between the housing base 6 and the housing cap 9, a cap-shaped cover 10 is disposed to separate the distributor rotor 4 from the space below so that, first, the high voltage at the rotor electrode **4*b* and a fixed electrode 9*c* does not leak into the space therebelow, and, second, the water entering from the ventilating holes (not shown) around the spark advancing mechanisms, etc., does not reach the high-voltage distributing portion at the distributor rotor 4. The cap-shaped cover 10, which is made of a resin and has a central circular hole at the flat disk-shaped top portion of the cap to allow the central portion of the distributor rotor 4 to extend downward therethrough, comprises an annular flange 10*a* which is held between the annular end surfaces of the housing base 6 and the housing cap 9, an annular sealing member 11 being disposed between the upper surface of the flange 10*a* and the lower end surface of the housing cap 9. The lower surface of the flange 10*a* has an annular groove near the outer circumference thereof, which engages an annular projection formed on the inner half portion of the upper end surface of the housing base 6, as shown in FIG. 4**.

Figure 2:
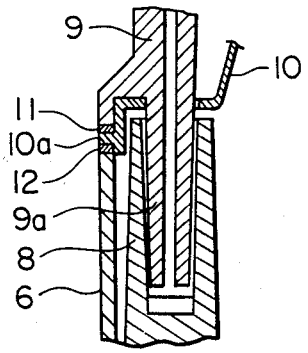
FIG. 2 is an enlarged sectional view of a portion of the distributor of FIG. 1 at which electrical connection is made to supply the high output voltage from the ignition coil to the high voltage distributing portion.

The sealing structure of the engaging portion of the high-voltage tower 8 according to the present invention is shown in detail in FIG. 4. A cap-shaped sealing member 16, which is made of rubber and has a circular hole at the disk-shaped flat top portion thereof to allow the insertion electrode **9*a* to extend therethrough, is fitted onto the top portion of the high-voltage tower 8. The cover 10 comprises a cap-shaped portion 10*b* fitted onto the cap-shaped sealing member 16, the flat disk-shaped top portion of the cap-shaped portion 10*b* having a circular central hole for allowing the insertion electrode 9*a* to extend therethrough. At the cap-shaped portion 10*b*, the flange 10*a* of the cover 10 is formed on the outer side surface of the cap-shaped portion 10*b*, as shown at FIG. 4. The annular disk-shaped top portion of the sealing member 16 is tightly held between the annular top end surface of the high-voltage tower 8 and the annular disk-shaped top portion of the cap-shaped portion 10*b* of the cover 10. In addition, the hollow cylindrical auxiliary side wall portion 16*a* of the cap-shaped sealing member 16, which has a plurality of annular projections at the outer circumferential surface thereof, is held between the outer circumferential surface of the top portion of the high-voltage tower 8 and the inner surface of the hollow cylindrical side wall portion of the cap-shaped portion 10*b* of the cover 10. Further, when the insertion electrode 9*a* is inserted into the bore in the high-voltage tower 8, the inner surface of the central circular hole formed in the disk-shaped top portion of the sealing member 16 is tightly pressed against the outer circumferential surface of the insertion electrode 9*a*. As a result, the entrance to the gap between the bore in the high-voltage tower 8 and the insertion electrode 9*a* is sealed in a watertight manner, so that no water can enter the bore of the high-voltage tower 8 to reach the high-voltage portion therein. Thus, the sealing member 12 of the conventional housing structure shown in FIGS. 1 and 2 can be omitted without any serious adverse effects. The sealing member 12 utilized in the above-described conventional structure has a complicated form corresponding to the contour of the lateral cross section of the housing, needs much care in handling, and is expensive to produce; thus, the omission thereof contributes greatly to a reduction in the production cost of the distributor. However, the conventional sealing member 12 may be utilized between the flange 10***a* of the cover 10 and the annular end surface of the housing base 6 as shown in FIGS. 1 and 2, in cases where production cost is not important.

Figure 5:
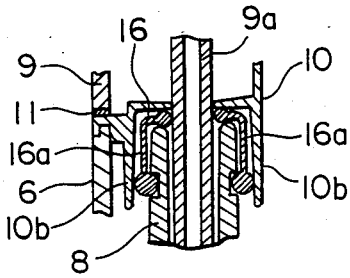
FIG. 5 is a view similar to FIG. 4, but showing a second sealing structure according to the present invention.

FIG. 5 shows a second sealing structure of the engaging portion of the high-voltage tower according to the present invention. The sealing structure is substantially the same as that shown in FIG. 4. The thickness of the cap-shaped sealing member 16, however, is reduced, and torus-shaped annular expanded portions having a circular cross section are formed at the bottom end portion of the cap and at the periphery of the central hole formed in the disk-shaped top portion of the cap. The inner semicircular portion of the torus-shaped expanded portion formed at the bottom of the cap-shaped sealing member 16*a* fits into an annular groove formed on the outer circumferential surface of the high-voltage tower 8, the expanded portion being held between the high-voltage tower 8 and the downwardly extending side wall portion of the cap-shaped portion 10*b* of the cover 10. The torus-shaped expanded portion formed at the periphery of the central hole in the disk-shaped top of the sealing member 16 is tightly held between the annular top end surface of the high-voltage tower 8 and the annular disk-shaped top of the cap-shaped portion 10*b* of the cover 10, the inner side surface thereof being tightly pressed against the outer side surface of the insertion electrode. As a result, the engaging portion of the high-voltage tower 8 is sealed in a watertight manner.

Figure 6:
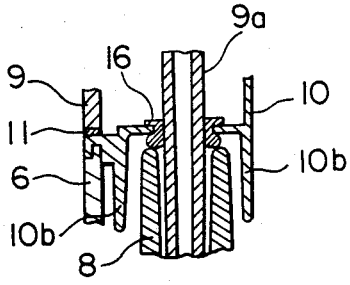
FIG. 6 is also a view similar to FIG. 4, but showing a third sealing structure according to the present invention.

FIG. 6 shows another modification of the sealing structure of FIG. 4. The structure shown at FIG. 6 is similar to that shown in FIG. 4, except for the sealing member 16, which is substantially annular and has an annular groove at the outer side surface thereof, the annular groove engaging the inner portion of the annular disk-shaped top of the cap-shaped portion 10*b* of the cover 10, the annular bottom surface of the sealing member 16 being pressed against the upper annular top end surface of the high voltage tower 8. The annular inner side surface of the sealing member 16, on the other hand, is pressed on the outer side surface of the insertion electrode 9*a*. As a result, the engaging portion of the high voltage tower is sealed in a watertight manner.

What is claimed is:

1. A housing structure of a distributor for an internal combustion engine including an ignition coil, comprising:

a cup-shaped housing base through which a shaft of the distributor rotatably extends, said cup-shaped housing base accommodating an ignition coil;

first high-voltage lead means connected to said ignition coil for leading high output voltage from a secondary winding of said ignition coil, said first high-voltage lead means including a hollow cylindrical member which extends in an axial direction of the distributor and has a central bore extending thereinto from a top end surface of said hollow cylindrical member;

a housing cap fitted onto said cup-shaped housing base and accommodating a high-voltage distributing portion of the distributor;

second high-voltage lead means fixed to said housing cap for leading high voltage supplied from said first high-voltage lead means to the high-voltage distributing portion of the distributor, said second high-voltage lead means including a solid cylindrical member which extends in the axial direction of the distributor and fits into said central bore in said hollow cylindrical member;

a partitioning member interposed between said housing base and said housing cap to separate the high-voltage distributing portion of the distributor, said partitioning member including a side extension which has a hole for allowing said cylindrical member of said first high-voltage lead means to extend therethrough; and a first sealing member including a sealing portion tightly held between a top portion of said hollow cylindrical member of said first high-voltage lead means and said side extension of said partitioning member, and a sealing surface tightly pressed against an outer side surface of said solid cylindrical member of said second high-voltage lead means.

2. A housing structure of a distributor as claimed in claim 1, wherein;

said partitioning member is cap-shaped and has an outwardly extending flange formed at an outer side surface thereof, the flange being held between annular end surfaces of said housing base and said housing cap; and said housing structure further comprises an annular sealing member disposed between said flange and the annular end surface of said housing cap.

3. A housing structure of a distributor as claimed in claim 1, wherein said side extension of said partitioning member has the form of a cap with an annular disk-shaped top thereof having a central hole through which said solid cylindrical member of said second high-voltage lead means extends, a hollow cylindrical side wall portion of the cap-shaped extension of said partitioning member surrounding a top portion of said hollow cylindrical member of said first high-voltage lead means.

4. A housing structure of a distributor as claimed in claim 3, wherein said first sealing member in the form of a cap includes:

an annular disk-shaped top having a hole through which said solid cylindrical member of said second high-voltage lead means tightly extends, the annular disk-shaped top of said first sealing member being tightly held between the annular disk-shaped top of said cap-shaped extension of said partitioning member and an annular top end surface of said hollow cylindrical member of said first high-voltage lead means; and a hollow cylindrical side wall held between the hollow cylindrical side wall portion of said cap-shaped extension of said partitioning member and an outer side surface of a top portion of said hollow cylindrical member of said first high-voltage lead means.

* * * * *